US005133475A

United States Patent [19]

Sharp

[11] Patent Number: 5,133,475

[45] Date of Patent: Jul. 28, 1992

[54] STORAGE TANK WITH INTEGRAL MANWAY

[76] Inventor: Bruce R. Sharp, 7685 Fields-Ertel Rd., Cincinnati, Ohio 45241

[21] Appl. No.: 654,523

[22] Filed: Feb. 13, 1991

[51] Int. Cl.[5] ..... B65D 7/02

[52] U.S. Cl. ..... 220/589; 220/592; 220/648; 220/661

[58] Field of Search ..... 220/661, 565, 85 VR, 220/85 VS, 648, 592, 589

[56] References Cited

U.S. PATENT DOCUMENTS 3,298,560 1/1967 Anderson ..... 220/661
3,680,727 8/1972 Pearson ..... 220/3
3,827,595 8/1974 Reynolds ..... 220/661
4,359,167 11/1982 Fouss et al. ..... 220/565
4,655,367 4/1987 Palazzo ..... 220/445
4,685,327 8/1987 Sharp ..... 73/49

*Primary Examiner*—Joseph Man-Fu Moy
*Attorney, Agent, or Firm*—Charles R. Wilson

[57] ABSTRACT

A storage tank comprises a cylindrical-shaped main body, end caps, a manway and a set of support ribs extending circumferentially around the main body. The manway is integral with a main body of the storage tank and has a side wall which extends generally vertically from the main body with a terminus which forms a substantially horizontal plane and defines an opening. A manway lid is dimensioned to cover the opening and has means to removably secure it to the manway. The cylindrical-shaped main body and manway are formed together using a fibrous reinforcing material and a resinous material so as to be integral with one another.

9 Claims, 3 Drawing Sheets

STORAGE TANK WITH INTEGRAL MANWAY

This invention relates to storage tanks. More particularly, the invention relates to underground storage tanks of fibrous reinforced resinous material with an integral manway.

BACKGROUND OF THE INVENTION

Storage tanks having a capacity of 1,000 gallons of liquid or more are used for the bulk storing of commercial and industrial liquids of all types. Underground storage tanks used by retail service stations to store gasoline are one very common example of such storage tanks. It is necessary that these storage tanks be reliable because of the nature of the liquids being stored. The tanks must also be economically built.

Most of the bulk storage tanks being built are either made of steel or of a fiberglass reinforced resinous material. The steel tanks are expensive due primarily to raw material costs. Additionally, the resultant tanks are difficult to ship and install because of their weight. Special steps also must be undertaken to guard against corrosion. Fiberglass reinforced resinous tanks do not suffer from the same disadvantages. However, a prime drawback they suffer from is that they are very labor intensive to build.

Storage tanks made from fiberglass and resinous materials are commonly formed on a mold. In one commercial method, a reuseable cylindrical-shaped half-mold is used to form the tank's body. Initially, layers of fiberglass followed by a resinous coating are applied to the mold or, alternatively, streams of chopped fiberglass and liquid resin are simultaneously directed onto the mold and subsequently cured. Sufficient applications of the fiberglass and resin are made until a wall thickness is obtained which has the desired strength. Next, rib forms, four to six inches wide, are placed completely around the covered mold at approximately sixteen inch intervals and then fiberglass/resin applied over the rib forms. Curing of the resin results in a cylindrical-shaped tank with ribs. The purpose of the ribs is to add strength to the tank. The mold is finally removed. A cylindrical-shaped half-tank, including the support ribs are produced in this stage of the method. An end cap is either fabricated during the cylinder wall-making step or added after the mold is removed. The above steps are repeated to obtain a second half-tank. The two half-tanks are then joined together by appropriate sealing means. The formed tank is representative of a tank constructed by adding spaced support ribs to the outer surface of a cylindrical-shaped inner tank and then securing said ribs to the tank.

A second method of making tanks from fiberglass reinforced resinous material utilizes a removable split half-mold with shapes for forming the support ribs and end cap along with the main body. The tank can be formed on the exterior side of the mold or, preferably, on the interior side of the mold. Fiberglass and resinous material are applied to the mold and cured, and then the mold is removed. Next, the interior portions of the rib areas are filled with a filler material or bridged over with an insert and, fiberglass/resin applied so as to form a substantially smooth tank interior. A second half-tank is formed in the same manner and joined with the first half-tank. The formed tank is representative of those tanks wherein the support ribs are built into the tank as initially made.

Various access lines extend into the storage tanks above described. Thus, a fill line, dispensing line and vent line are provided. Individual holes can be provided in the top of the tank and fitted with bushings. Each access line is then secured in a leak proof manner to a bushing. It is also possible and is common practice to provide the storage tank with a premade manway and manway lid. The manway is typically about two feet in diameter and is placed in a top central locale of the tank. A hole is initially cut to the proper dimensions in the top of the tank and the manway positioned therein. It is permanently attached normally with fibrous reinforcing and resinous materials.

Each known method of building a storage tank from a fibrous reinforced resinous material produces two half-tanks which must be joined together and sealed. The seam area, of course, must have adequate strength to withstand substantial forces from within as well as ground movement forces. The seams also must be joined in a liquid tight fashion. This has been difficult and, in fact, the seams have the highest potential for a future leakage problem. Having to join the premade manway to the tank and seal them together is one of the labor steps which adds substantial cost to the building of this type of storage tank. It additionally creates another seam area with its potential for leakage.

There is a need for an economical method to build a storage tank from a fibrous reinforced resinous material. The resultant tank must have sufficient strength to withstand forces normally encountered by underground storage tanks. In accord with this need, there has been developed a storage tank system with an integral manway. The systems are built with a minimum of capital intensive equipment and a minimum of labor.

SUMMARY OF THE INVENTION

A storage tank made from fibrous reinforcing and resinous materials has an integral manway. The storage tank comprises a cylindrical-shaped storage tank having a main body with end caps at each end. A manway extends from the main body of the storage tank and is contiguous therewith. The manway has generally vertical side walls, the terminus of which forms a horizontal plane and defines an opening. Also provided is a manway lid dimensioned to cover the terminus of the manway and means to removably secure the lid to the manway. Support ribs extending circumferentially around the tank are added for strengthening purposes.

DETAILED DESCRIPTION OF THE INVENTION

Figure 1:
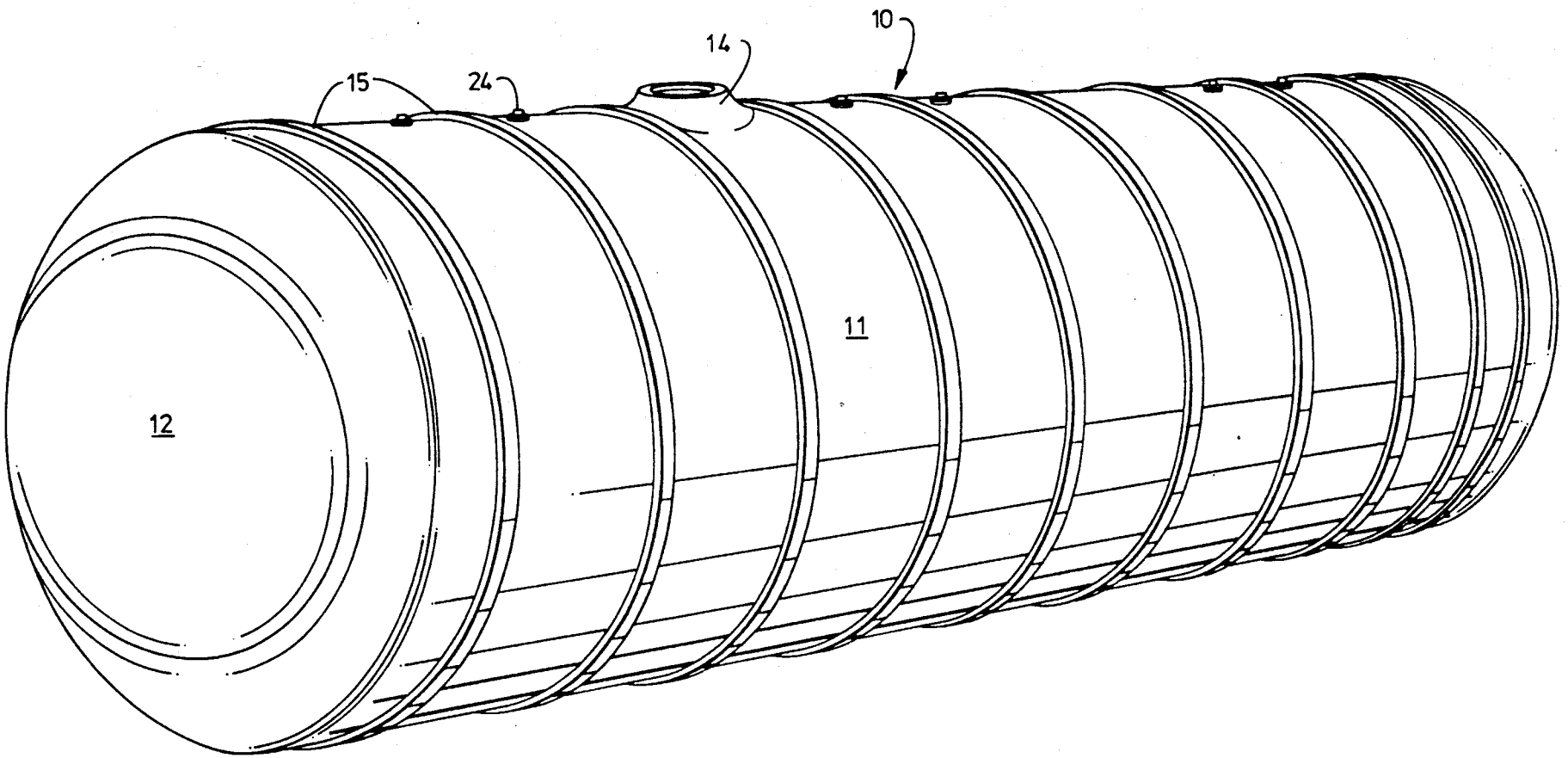
FIG. 1 is a perspective view of a storage tank of this invention wherein the integral manway has side walls which extend contiguously and upwardly from the surface of the storage tank's main body.

With reference to FIGS. 1-4 there is shown a storage tank 10 of this invention. The storage tank comprises a cylindrical-shaped main body 11, domed end caps 12 and 13, manway 14 and support ribs 15. The storage tank has a capacity of at least about 1,000 gallons of liquid, preferably at least about 4,000 gallons liquid. More preferably, the storage tank is built to be used in retail gasoline service stations and has a capacity of from about 5,000 gallons to about 20,000 gallons.

The main body 11 and manway 14 of the storage tank 10 are of one piece construction and are formed from fibrous reinforcing material and resinous material. Preferably each of the end caps 12 and 13 is also an integral part of the storage tank, though each can be separately formed and attached to the main body as described below.

Figure 4:
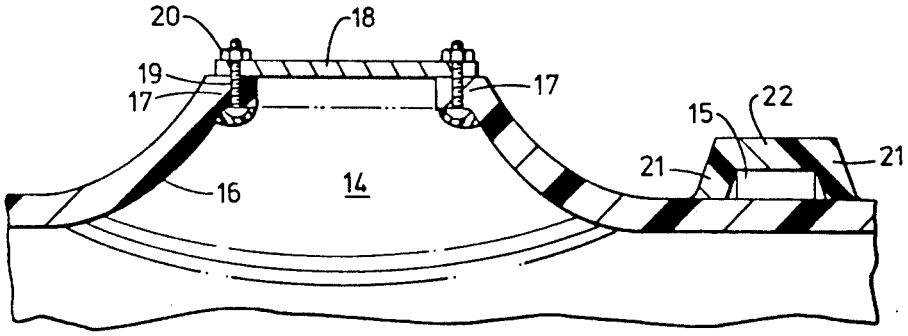
FIG. 4 is an enlarged partial view of the storage tank of FIG. 1 showing in detail the manway and a manway lid.

The manway 14 of the storage tank 10 extends substantially vertically from the main body in a top central locale thereof. Because of the mode of building the tank using split half molds as described below, the manway will normally not be positioned in the exact center of the main body's top surface. It will be more normally located off-center. As best seen in FIG. 4, the manway 14 and main body 11 are integral. That is, they are a one piece construction with no seams. The manway comprises a substantially vertical side wall 16 which extends upwardly and contiguously to about thirty inches from the top surface center line of the main body. Preferably, the side wall of the manway ranges from about one inch to about eighteen inches in height. The manway is generally cylindrical-shaped with a side wall sloping inwardly towards the terminus. The diameter of the manway terminus is from about fourteen inches to about thirty-six inches, preferably about eighteen inches to about thirty inches. An inwardly directed flange 17 on top of the manway provides a surface on which a manway lid 18 is able to rest. The flange has a set of bolt holes and bolts 19 extending therethrough. Preferably, the heads of the bolts are permanently encased by resinous material to the underside of the flange with a set of nuts 20 attached at the upper outside surface of the flange and manway lid 18 for ready access.

Each support rib 15 on the storage tank 10 has two generally vertical side walls 21 and a generally flattened top wall 22. Each rib is about three inches to about five inches wide and about one inch to about three inches in height. The ribs are located on the main body at about six inches to about twenty-four inches on center at uniform intervals thereacross. As described below, the support ribs of this storage tank are added to the main body after its formation. The ribs act as support so that the weight of the tank, including the contents therein, is evenly distributed and add strength needed to withstand external load forces.

Figure 2:
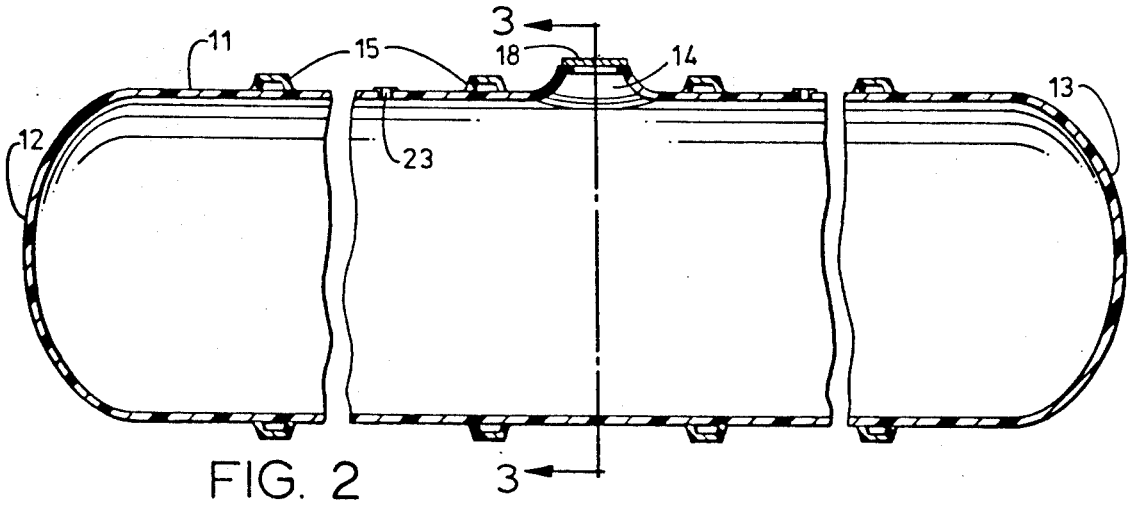
FIG. 2 is a side view in section of the storage tank depicted in FIG. 1.

Depicted in FIGS. 1 and 2 are bushings in holes at the top of the tank which can be used for receiving necessary access lines such as a fill line, dispensing line and vent line. The access lines could as well enter the tank through holes in the manway lid and manway. Plugs 24 are provided for the bushings 23 when a line does not enter the opening. Such lines and their mode of attachment are conventional in nature.

The storage tank 10 does not have a seam at the manway's base. As such, there is no concern as to this area being a potential for breaking and leaking. At the same time, the storage tank is provided with a manway for gaining ready access to the tank's interior. There is no substantial increase in building costs and actually a decrease in production time.

Figure 5:
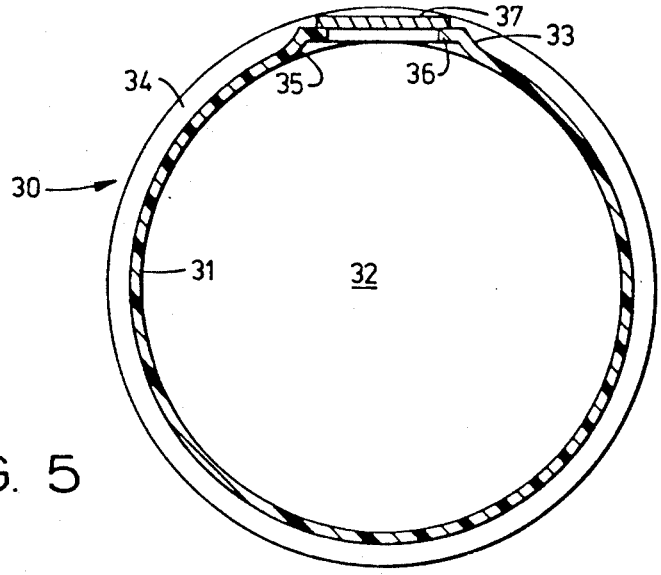
FIG. 5 is an end view partially in section showing a storage tank of the invention wherein the terminus of the manway is substantially even with the center line of the top surface of the storage tank's main body.

FIG. 5 illustrates another storage tank of the invention similar in all respects to the storage tank 10 of FIGS. 1-4, other than its manway construction. Thus, the storage tank 30 has a main body 31, end cap 32, manway 33 and support ribs 34. The terminus of the manway 33 is substantially even with the center line of the top surface of the main body 31. As such, the side wall 35 of the manway 33 ranges from being non-existent at the center line of the 10 top surface of the main body to about six inches to about ten inches in length at the lowermost point on the main body it extends from. The manway 33 is generally cylindrical-shaped with a side wall which slopes inwardly towards the terminus. The main body and the side wall of the manway are contiguous. As such, the same benefits are obtained as described about with respect to the storage tank of FIG. 1. An inward flange 36 at the terminus of the manway is used to secure a manway lid 37 thereto.

Figure 6:
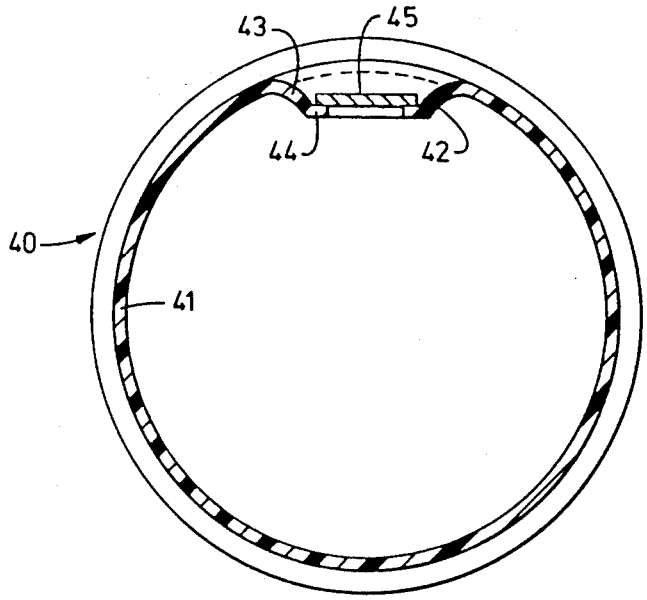
FIG. 6 is an end view partially in section of a storage tank of the invention wherein the manway has sidewalls which extend contiguously and downwardly into the storage tank.

FIG. 6 illustrates another storage tank 40 of the invention. In this aspect of the invention, the main body 41 has a manway 42 with a substantially vertical side wall which extends downwardly and contiguously into the interior storage area of the storage tank. The manway 42 is generally cylindrical-shaped with a side wall which slopes inwardly towards the terminus. Thus, the side wall 43 of the manway ranges in length from about six inches to about eighteen inches below the center line of the top surface of the main body. An inwardly extending flange 44 is used to receive a manway lid 45. The advantage of this storage tank is that an internal retained capacity area is formed within the upper portion of the storage tank above a horizontal plane extending from the lower terminus of the manway 42. By proper venting, the internal retained capacity area can act to receive excess liquid from a filling operation.

Figure 7:
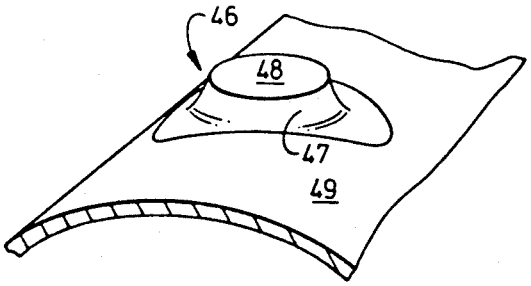
FIG. 7 is a partial view in perspective showing a manway saddle on a collapsible mandrel used in the method of building the storage tank of FIG. 1.
Figure 3:
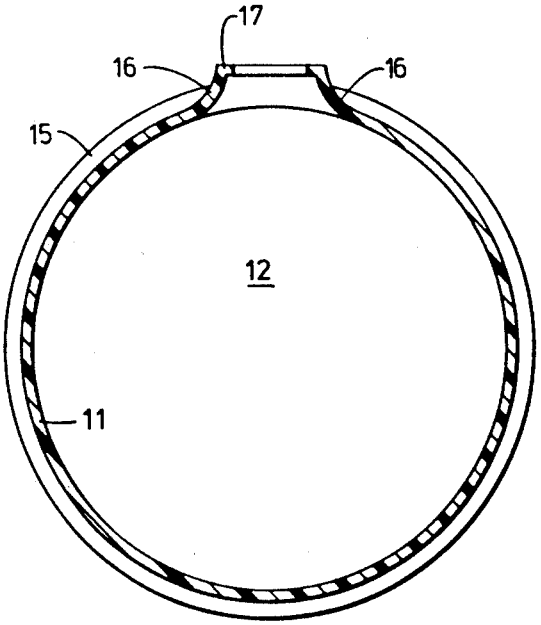
FIG. 3 is an end view in section of the storage tank of FIG. 2 taken along line 3—3 thereof.

The storage tanks of the invention as described above are built by any one of several different methods. In one method which requires a minimum of new steps from that normally used, a conventional collapsible male half mandrel is used. The mandrel forms a mold on which is built a horizontal half-tank. With respect to the storage tanks of FIGS. 1 and 5, a manway saddle is initially positioned on the mandrel. The manway saddle 46 is shown in FIG. 7. It comprises a solid frame with a generally vertical side wall 47 which slopes inwardly. The frame also has a flat top surface 48. The dimensions of the saddle approximate those of the manways above described. Means are provided to temporarily hold the saddle on the mandrel 49. Once positioned, a fibrous reinforcing material and a liquid resinous material are applied in a conventional fashion to the complete mandrel and manway saddle to form a half-tank with manway. With respect to the storage tank of FIG. 6, the half mandrel on which the tank is formed must be constructed to have a depression in the mandrel's surface in the shape of the manway.

Fibrous materials made of fiberglass, nylon, etc. in screen, mesh, continuous strand and chopped strand form are used in the tank building method. The form of the fibrous material is dictated by the mode of production. Resinous materials include the polyesters, e.g. vinylester and isophthalic polyesters, polyurethanes and polyepoxides. Other fibrous and resinous materials are used, it being understood the aforementioned materials are only exemplary of the many materials which can be used.

A preferred technique to apply the fibrous and resinous materials utilizes a two-head spray gun to spray separate streams of chopped fibrous material and liquid resin material onto the mold. The spray applications are controlled to form a desired thickness of materials which are subsequently dried of solvent and cured. If needed, a series of spray applications is used to build the wall's thickness until eventually a wall of proper strength is obtained. Alternately, sheets of fibrous material and resinous material are applied to the mold. Sufficient resin is sprayed to normally saturate the fibrous sheet or at least penetrate the sheet's surface to form a continuous solid outer surface. The resin is subsequently cured. Still another known technique used to build tanks of this invention is to supply filament windings of fibrous strands around the tank mold. The strands are saturated with liquid resin at the time of winding or the liquid resin is applied shortly thereafter and cured. In all instances, the main body and manway of the storage tank are formed together in one operation so as to be contiguous, i.e. they are unbroken.

The end caps of the storage tank are preferably formed at the same time as formation of the main body and manway. Alternatively, each is formed at a remote locale and attached to the formed main body as a separate step.

The circumferentially extending support ribs are positioned around the above described main body and are secured thereto. The ribs can as well be secured to the main body prior to the end caps being added thereto, though for ease of manufacturing are normally added as the last step.

The support ribs are typically made from a rigid core. The cores are first placed across the main body. Next an overlay of fibrous reinforced resinous material is used to secure the ribs to the tank and form a rigid support rib. The overlay is added by applying a layer of fibrous reinforcing material over each support rib and applying a resinous material onto or with the fibrous reinforcing material. When the resinous material is cured the overlay is rigid and securely bonded to the core and main body. The reinforcing material can be applied as a sheet of fiberglass, nylon or other synthetic fibrous material or in the form of chopped strands from a spray gun. In the latter case, the resinous material is applied substantially simultaneously and also in a spray form. Curing the resin occurs within minutes.

The support ribs in FIG. 1 are hollow and have a trapezoid shape. The ribs can also be built from a foam mold such that the foam and a subsequently applied overlay act as rigid support ribs. Other rib structures made from pre-casted materials in various shapes can as well be used. Most importantly, the ribs are rigid and are secured to the cylindrical-shaped main body.

After the resinous material has cured to a solid state, the mandrel is internally collapsed and removed. The manway saddle is next removed by pulling it into the interior of the formed tank. Preferably, a release agent has been applied to the manway saddle prior to any resinous material. Similarly, a second half of the main body is formed. The two halves are joined and sealed to form a complete tank. A hole is finally cut into the section formed on the flat top surface of the manway saddle to form a means by which entry can be made into the tank.

While not shown, the manway saddle used in forming the storage tank of FIG. 1 can be left in place and, in effect, become a part of the storage tank. The saddle provides added rigidity while not effecting the contiguous nature of the main body and manway walls.

It should be apparent in the tank building methods described there is always formed two half-tanks. The halves can be horizontal halves comprised of a bottom half and a top half which are joined together by a horizontal seam. The halves can as well be lateral halves comprised of a left half and a right half which are joined together by a vertical seam. As used herein, the term "halves" is used to signify two pieces which are about equal in size, though need not be exactly equal. The manway is preferably located off-center when lateral tank-halves are built to eliminate a seam through the manway.

Figure 8:
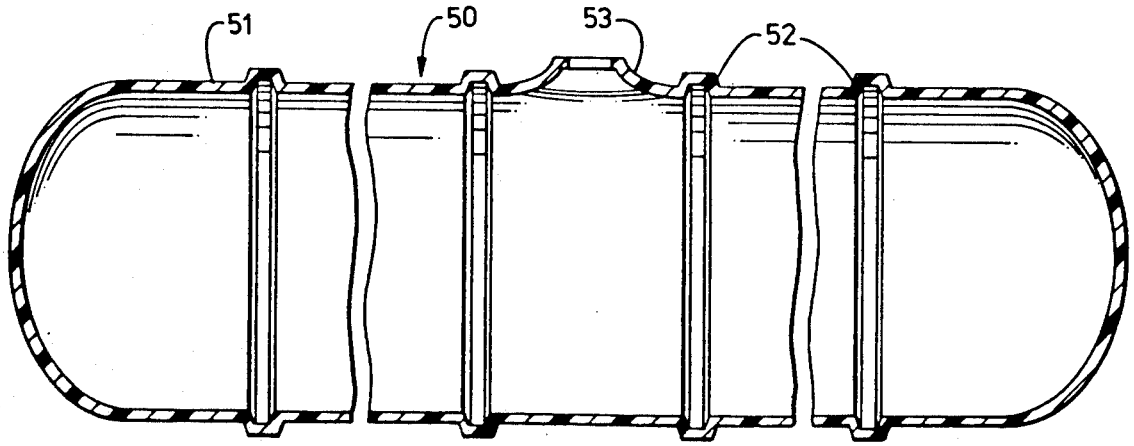
FIG. 8 is a side view of still another storage tank illustrating a storage tank wherein the support ribs and the manway are both an integral part of the storage tank.

The storage tank 50 of FIG. 8 forming a part of this invention is formed in a conventional fashion, though different from that described with respect to the storage tanks of FIGS. 1, 5 and 6. In this method, a cylindrical-shaped mold in the form of a lateral half of the storage tank is provided with contoured sides in the form of ribs. The ribs extend circumferentially around the mold. A form for the manway is built into the mold. As a result of the mold's contour, the main body 51, support ribs 52 and manway 53 are all formed together.

The storage tank 50 is made by building two half-tanks and joining them together. A half-tank is initially made by applying a fibrous material and a resinous material to the mold. The fibrous and resinous materials as well as their mode of application to the mold are the same as above described with respect to the storage tanks of FIGS. 1, 5 and 6. The mold on which the fibrous reinforced resinous material tank is formed is collapsed or opened and removed. Next, another half-tank formed in the same manner is abutted against the first half-tank and securely joined. Finally, a hole is cut into the flat top surface of the manway 53 and a manway lid attached thereto. The resultant full tank is a single walled structure. The ribs are characterized in being hollow and open to the tank's interior.

The storage tank of this invention has been described in particularity with reference to the drawings. It should be apparent that other variations of the storage tank and other methods of producing the storage tank are possible. All obvious variations are considered within the scope of the claims.

What is claimed is:

1. A ribbed storage tank having an integral manway for gaining access to the storage tank's interior, said storage tank comprising:

(a) a cylindrical-shaped storage tank having a capacity of at least about 1,000 gallons liquid, said storage tank made of a fibrous reinforced resinous material and having a main body with a set of support ribs extending circumferentially therearound wherein the support ribs are located on said main body at uniform intervals of about six inches to about twenty-four inches on center and further with end caps at each end;

(b) a manway contiguous with the main body of the storage tank and positioned so as to extend from the main body, said manway made of a fibrous reinforced resinous material and further characterized in having a generally vertical side wall up to about thirty inches in height the terminus of which forms a horizontal plane and which defines an opening about fourteen inches to about twenty-six inches in diameter;

(c) a manway lid dimensioned to cover the terminus of the manway; and (d) means to secure the manway lid to the manway so as to seal the interior of the storage tank.

2. The storage tank of claim 1 wherein the manway is positioned in a substantially central locale of the top surface of the main body of the storage tank.

3. The storage tank of claim 1 further wherein the manway has a flange at the terminus of its side wall, said flange extending inwardly from the side wall and further having a set of bolt holes to receive bolts so as to secure the manway lid to the manway.

4. The storage tank of claim 3 further wherein the set of bolts are positioned in the bolt holes of the manway flange to extend upwardly therethrough and are permanently attached to said flange.

5. The storage,tank of claim 1 wherein the storage tank has a capacity of from about 5,000 gallons to about 20,000 gallons liquid.

6. The storage tank of claim 1 wherein the side wall of the manway ranges from about one inch to about eighteen inches in height and the terminus of the manway side wall defines an opening about eighteen inches to about thirty inches in diameter.

7. The storage tank of claim 6 wherein the manway extends upwardly from the main body.

8. The storage tank of claim 6 wherein the manway extends downwardly from the main body.

9. The storage tank of claim 6 wherein the terminus of the manway side wall is substantially even with a center line of the top surface of the main body.

* * * * *